United States Patent [19]

Hsu

[11] 4,269,132

[45] May 26, 1981

[54] POSITION INDICATING UNIT FOR SEWING MACHINES

[76] Inventor: Yung-San Hsu, No. 132, Ho Ping Rd., Hsi Men Li, Tao Yuan City, Taiwan

[21] Appl. No.: 877,300

[22] Filed: Jan. 13, 1978

[51] Int. Cl.[3] ..... D05B 69/22

[52] U.S. Cl. ..... 112/275; 318/653

[58] Field of Search ..... 112/275, 277, 158 E, 112/67, 87; 324/208; 318/254 A, 480, 640, 653; 340/679, 686, 672, 666

[56] References Cited

U.S. PATENT DOCUMENTS

| | | | |
|---|---|---|---|
| 3,176,641 | 4/1965 | Palmer | 112/275 |
| 3,465,327 | 9/1969 | Schroter et al. | 340/686 |
| 3,553,671 | 1/1971 | Hopkins | 340/686 X |
| 3,582,739 | 6/1971 | Daab et al. | 112/275 X |
| 3,815,531 | 6/1974 | Wurst et al. | 112/275 X |
| 3,881,435 | 5/1975 | Makabe | 112/275 |
| 3,896,280 | 7/1975 | Blake | 340/686 X |
| 4,014,275 | 3/1977 | Herr et al. | 112/158 E |
| 4,055,131 | 10/1977 | O'Brien et al. | 112/158 E |
| 4,134,049 | 1/1979 | Gray | 318/480 |
| 4,140,971 | 2/1979 | Blincoe | 324/208 |

*Primary Examiner*—Werner H. Schroeder
*Assistant Examiner*—Andrew M. Falik
*Attorney, Agent, or Firm*—McAulay, Fields, Fisher, Goldstein & Nissen

[57] ABSTRACT

A position indicating unit of sewing machines, and more particularly a position indicator installed in sewing machines, having a magnet, pole plates, Hall effect ICs, amplifying actuating circuits and a visual signaling device to indicate and monitor the operation of automatic needle position control system, and to cause a conventional needle braking mechanism or the like to stop the sewing machine at a given position.

3 Claims, 2 Drawing Figures

POSITION INDICATING UNIT FOR SEWING MACHINES

DETAILED DESCRIPTION OF THE INVENTION

This invention relates to a position indicating unit of sewing machines.

More particularly the invention is concerned with an arrangement comprising a magnet, pole plates, Hall effect ICs, amplifying actuating circuits and a visual indicating device such as light emitting diodes, to be installed in a sewing machine for indicating and monitoring the operation of an automatic needle position control system being operable to control a conventional needle braking mechanism to stop the sewing machine at a given position.

There are many types of conventional automatic needle positioners for sewing machines, that are for use in automatically stopping the needle of a sewing machine at a preset position each time the machine stops, where said automatic needle positioner is so adjusted to stop the sewing machine at the desired position in accordance with the requirements of the sewing operation. However, without some positive visual indication of the response of the position sensors, the adjustment of said automatic needle positioner requires considerable skill and requires adjustments to reach the desired settings. These numerous adjustments are not only time consuming, and laborious but also require an experienced person to make them. This easily leads to an incorrect setting or confusion in case of a defective sensor unit without proper means to indicate the operation of the positioning system.

The main object of this invention is to improve the defects noted above and to provide a position indicating unit for sewing machines to be installed in sewing machines for monitoring and controlling the operation of an automatic needle positioning system so as to simplify position setup.

Another object of this invention is to provide a positive functional monitor to indicate the operation of the automatic needle positioner system for sewing machines for maintenance or operation.

The construction, features and functions of this invention will be explained more fully with reference to the drawings attached herewith, as follows:

DESCRIPTION OF THE PREFERRED EMBODIMENT

Figure 2:
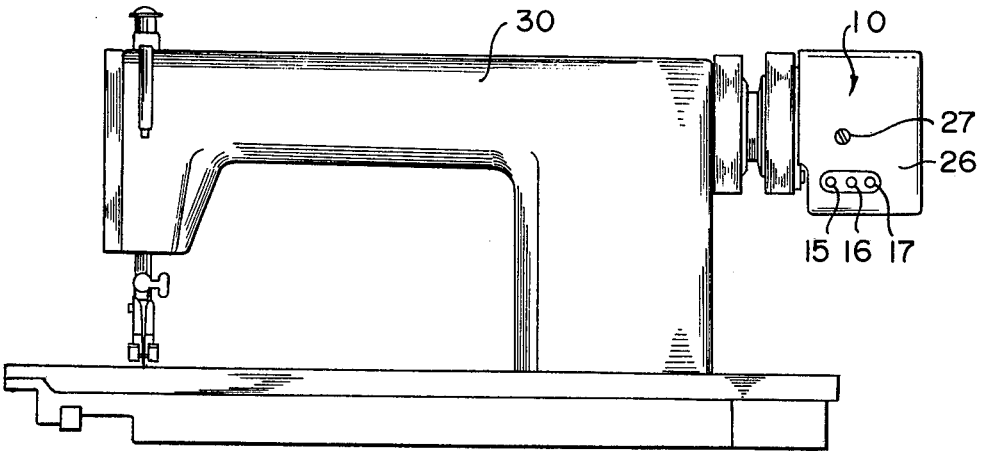
FIG. 2 is a front view of the position indicating unit of this invention installed in a sewing machine.
Figure 1:
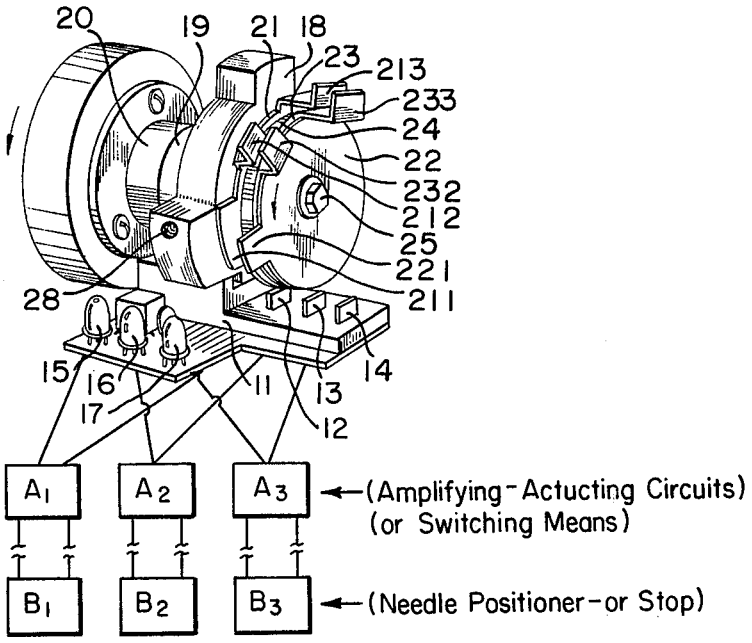
FIG. 1 is a perspective view of the position indicating unit of this invention.

As shown in the embodiment of these drawings, the position indicating unit is provided with a base plate 11 having Hall effect ICs 12, 13, 14 and light emitting diodes 15, 16, 17 installed thereon associated with the amplifying actuating circuits or switching mechanisms A1, A2, and A3 respectively, and a positioning shaft housing 18 which is also fixed on the base plate 11. At the center of the base plate 11, a hole is provided to allow the installment of the bearing 19 therein so that a positioning shaft 20 connected to the positioner as exemplified by B1, B2 and B3 (now shown in the drawings) can be disposed therethrough and rotate freely.

Magnetic pole plates 21, 22, 23 and magnet 24 are disposed around said positioning shaft 20 and are fastened securely with a bolt 25. Three lugs 211, 212, 213 are formed on said magnetic pole plates 21 with proper distancing in relation to one another so as to indicate respectively when the needle is in an up, down or thread cutting position, and are so formed that each lug is in a different plane of rotation (the plane that is vertical with respect to the axis of rotation). Pole plate 22 has one lug 221 while pole plate 23 has two lugs 232, 233, all three of them being in three different planes of rotation. The positions of said two lugs 232, 233 are symmetric with those of said two lugs 212, 213 of said pole plate 21 respectively. The lug 211 of the pole plate 21 is larger than the others in order that fine adjustment of the relative position between the pair of the lugs 211–221, and the pairs of the lugs 212–232, 213–233 can be done with the rotation of the lug 221 of the pole plate 22. Thus, by rotating the magnet 24 and the pole plates 21, 22, 23 along the direction of the arrow mark shown in the drawing the lug pairs can be disposed so that the lug pair 211, 221 is at both sides of Hall effect IC 12 thus indicating that the needle is in an up position, or lug pair 212, 233 at those of Hall effect IC 14, thus indicating that the needle is in the thread cutting position respectively. In this way the appropriate one of the sensing devices (that is Hall effect ICs) are actuated by magnetic flux passing therethrough to generate a signal voltage applied to amplifying circuits which make the light emitting diodes 15, 16, 17 emit light, and which can simultaneously activate a conventional needle braking mechanism.

The initial setting of the sewing machine can be completed by first turning the magnet 24 and the pole plates 21, 23 until the lug pairs 212–232, 213–233 are respectively positioned at both sides of Hall effect IC 13 and 14 making light emitting diodes 16 or 17 emit light, and then turning the pole plate 22 to have lug pair 221–211 positioned at both sides of Hall effect IC 12 making light emitting diode 15 emit light accordingly, and then adjusting the variation angles between the positioner and said magnet 24 and pole plates 21, 22, 23 to stop the sewing needle at top stop position, and finally fastening the bolt 25. During sewing operations when the sewing needle repeatingly moves up and down from top through thread axle to bottom position, the positioning shaft 20, being synchronized with said sewing needle and the magnet 24 and the pole plates 21, 22, 23 which are secured thereon, rotate and make the lug pairs 211,221, 212–232, and 213–233 pass through Hall effect ICs 12, 13, 14 accordingly, and make light, emitting diodes 15, 16, 17 emit light. Also voltage from the Hall effect IC's 12, 13 and 14 can operate a conventional needle 15 braking mechanism to stop the needle at a predetermined vertical position as disclosed in U.S. Pat. No. 3,881,435. The operation of the entire position control system can be therefore monitored by seeing whether or not the operation and sequence of light emission from said three diodes is proper. Whether or not the positioner is functioning properly can be seen at anytime without the need of testing with other equipment. FIG. 2 shows an illustration of the position indicating unit 10 attached to sewing machine 30, having a shield cover 26 and bolt 27 securing the unit in thread hole 28 of positioning shaft housing 18.

As described above, this invention uses a magnet and pole plates that are installed on a positioning shaft. The magnetic flux existing between pole plates and lugs rotates with the rotation of said positioning shaft and therefore electric voltage is generated by Hall effect ICs making light emitting diodes emit light to indicate the actual operating condition of the indicator while simultaneously being able to activate a conventional control mechanism. Change of needle stopping position to a specifically desired position can of course be done by changing the corresponding relative position of lugs. Hall effect ICs, and light emitting diodes. It is beyond question that the similar techniques to the present invention fall within the scope of the present patent application.

What I claim is:

1. A position indicating unit for a sewing machine for indicating predetermined positions of the machine, including a positioning shaft which is connected to the positioner of the sewing machine; a magnet; magnetic pole plates that are disposed at both poles of said magnet; means responsive to said magnet and magnetic pole plates including more than one Hall effect IC; control means operative together with said responsive means to stop the machine at a predetermined down position, said control means also being operative together with said responsive means to stop the machine at a predetermined up position; means including more than one visual signaling device responsive to a juxtaposition of said magnet and said magnetic pole plates; more than one amplifying actuating circuit; and lugs on said magnetic pole plates, wherein the rotation of said magnet and said magnetic pole plates that are fixed onto the positioning shaft which actuates said rotation, makes the magnetic flux in between said pole plates and said lugs rotate through Hall effect ICs, thereby generating a voltage which goes further through amplifying actuating circuits making the visual signal device emit light to indicate the actual operation of said positioner.

2. A position indicating unit according to claim 1 wherein more than one said visual signaling device and their accessories are provided to indicate the operation of the positioner by the light emitted by said visual signaling device which are actuated in accordance with the position of the positioner.

3. A position indicating unit of a sewing machine comprising:

(a) a positioning shaft connected to the positioner of the sewing machine;

(b) a magnet mounted to said shaft;

(c) a first and a second pole piece mounted to said shaft in close proximity to a first pole of said magnet and a third pole piece mounted in close proximity to the other pole of said magnet thereby to induce magnetic fields of oppositely directed polarities in said pole pieces;

(d) a housing mounted in fixed spatial relation with respect to said shaft;

(e) a first, a second and a third Hall effect IC mounted on said housing in spaced-apart relation to each other in a row substantially parallel to said positioning shaft; said IC's being operable to provide a signal by the passage of magnetic flux therethrough.

(f) first, second and third lugs extending from said third pole and being a predetermined angular spaced-apart distance from each other which angular distance corresponds to three sewing machine positions to be indicated, and each being of sufficient extent and linearly spaced apart from the other a distance predetermined by the position of said Hall effect IC's, to pass in close proximity to a corresponding one of said Hall effect IC's;

(g) fourth and fifth lugs extending from said second pole piece and being operable when said second pole piece is rotated, to be positioned in proximity to said first and second lugs respectively and in predetermined spaced relation thereto to generate between respective ones of said lugs, a first and second magnetic flux field respectively, fourth and fifth said lugs being positioned with respect to said first and said second IC respectively, to pass said first and second magnetic flux fields through said first and said second IC respectively;

(h) a sixth lug extending from said third pole piece and being operable, when said third pole piece is rotated, to be positioned in proximity to said third lug and in predetermined spaced relation thereto, to generate, between said third lug and said sixth lug, a third magnetic flux field, said third and sixth lugs being positioned with respect to said third IC to pass said third flux field through said third IC;

(i) first, second and third amplifying actuating circuits connected to a respective one of said IC's and actuated by the signal from said IC's for control of said sewing machines; and (j) first, second and third light emitting diodes connected to a respective of said IC's and actuated by the signal to indicate which amplifying actuating circuit is actuated.

* * * * *